US010328704B2

(12) United States Patent
Katada et al.

(10) Patent No.: US 10,328,704 B2
(45) Date of Patent: Jun. 25, 2019

(54) INKJET PRINTER WITH INK RECEPTOR FOR RECEIVING INK AS WASTE LIQUID

(71) Applicant: RISO KAGAKU CORPORATION, Tokyo (JP)

(72) Inventors: Yasuhiro Katada, Ibaraki (JP); Akira Nishiyama, Ibaraki (JP); Shunta Nakamura, Ibaraki (JP); Naoto Tsujino, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/914,225

(22) Filed: Mar. 7, 2018

(65) Prior Publication Data

US 2018/0281424 A1 Oct. 4, 2018

(30) Foreign Application Priority Data

Mar. 29, 2017 (JP) ..... 2017-064378

(51) Int. Cl.
*B41J 2/165* (2006.01)
*B41J 2/17* (2006.01)
*B41J 2/21* (2006.01)

(52) U.S. Cl.
CPC ..... *B41J 2/1721* (2013.01); *B41J 2/16505* (2013.01); *B41J 2/16523* (2013.01); *B41J 2/16535* (2013.01); *B41J 2/2103* (2013.01); *B41J 2002/16573* (2013.01); *B41J 2002/1742* (2013.01)

(58) Field of Classification Search
USPC ..... 347/23
See application file for complete search history.

(56) References Cited

U.S. PATENT DOCUMENTS 6,578,945 B2 * 6/2003 Hashi ..... B41J 2/16585 347/22
2008/0036816 A1 2/2008 Nishida
2011/0074872 A1 3/2011 Ozaki et al.
2011/0301676 A1 12/2011 Hirabayashi
2011/0304676 A1 12/2011 Hirabayashi
2012/0056935 A1 3/2012 Nitta

FOREIGN PATENT DOCUMENTS

JP 4645172 12/2010

OTHER PUBLICATIONS

Official Communication issued in European Patent Office (EPO) Patent Application No. 18159138.9, dated Aug. 6, 2018.

* cited by examiner

*Primary Examiner* — Lam S Nguyen
(74) *Attorney, Agent, or Firm* — Greenblum & Bernstein, P.L.C.

(57) ABSTRACT

An inkjet printer includes: at least one ink receptor having a tray shape with a bottom plate and an opening facing upward and being horizontally movable; and a suction unit. The at least one ink receptor is configured to receive ink ejected from at least one inkjet head as waste liquid. The suction unit includes at least one suction nozzle arranged above the bottom plate within a movable range of the at least one ink receptor and is configured to suction the ink in the at least one ink receptor through the opening with the at least one suction nozzle.

2 Claims, 6 Drawing Sheets

INKJET PRINTER WITH INK RECEPTOR FOR RECEIVING INK AS WASTE LIQUID

CROSS REFERENCE TO RELATED APPLICATION

This application is based upon and claims the benefit of priority from the prior Japanese Patent Application No. 2017-064378, filed on Mar. 29, 2017, the entire contents of which are incorporated herein by reference.

BACKGROUND

1. Technical Background

The disclosure relates to an inkjet printer which performs printing by ejecting ink from an inkjet head.

2. Related Art

In an inkjet printer, a maintenance operation of an inkjet head is performed for removal of dust attaching to the inkjet head, stabilization of physical properties of ink in nozzles, and similar purposes.

As the maintenance operation of the inkjet head, for example, a series of operations is performed in which so-called purging is performed to forcedly eject the ink from the nozzles, and then a nozzle surface of the inkjet head is wiped with a wiper.

The ink ejected in the maintenance operation of the inkjet head as described above is received by an ink receptor. Then, the ink in the ink receptor is sent to a waste liquid tank and stored.

As a method of sending the ink from the ink receptor to the waste liquid tank, Japanese Patent No. 4645172 discloses a technique in which the ink is made to flow by its own weight to the waste liquid tank via an ink passage connected to a bottom surface of the ink receptor and extending downward.

SUMMARY

Among inkjet printers, there is an inkjet printer configured such that the aforementioned ink receptor horizontally moves between a position directly below the inkjet head where the ink receptor is disposed in the maintenance operation and a position retreated from the position directly below the inkjet head.

When the aforementioned ink passage is connected to the bottom surface of the ink receptor in such a configuration, the ink passage also moves as the ink receptor moves to perform the wiping. Accordingly, the ink passage with a length corresponding to a movement distance of the ink receptor needs to be provided. Moreover, a standby space for the ink passage with the length corresponding to the movement distance of the ink receptor needs to be provided below the ink receptor. Since many members are disposed below the ink receptor, it is difficult to provide the space for the ink passage and such a configuration may lead to an increase of an apparatus size.

The disclosure is directed to an inkjet printer which can suppress an increase of an apparatus size.

An inkjet printer in accordance with some embodiments includes: at least one ink receptor having a tray shape with a bottom plate and an opening facing upward, the at least one ink receptor being horizontally movable and configured to receive ink ejected from at least one inkjet head as waste liquid; and a suction unit including at least one suction nozzle arranged above the bottom plate within a movable range of the at least one ink receptor, the suction unit configured to suction the ink in the at least one ink receptor through the opening with the at least one suction nozzle.

In the configuration described above, unlike in a configuration in which the ink in the ink receptor flows to a waste liquid tank via an ink passage extending downward from a bottom surface of the ink receptor, a standby space for the ink passage with a length corresponding to the movement distance of the ink receptor does not have to be provided below the ink receptor. As a result, an increase of an apparatus size can be suppressed.

The at least one inkjet head may include inkjet heads. The at least one ink receptor may include ink receptors corresponding to the inkjet heads, respectively. The at least one suction nozzle may include suction nozzles corresponding to the ink receptors, respectively. The suction unit may include: a negative pressure tank shared by the suction nozzles and in which a negative pressure is generated for suctioning the ink in the ink receptors by the suction nozzles, the negative pressure tank configured to store the ink suctioned by the suction nozzles; an air pump shared by the suction nozzles and configured to generate the negative pressure in the negative pressure tank; and an ink suction passage connecting the suction nozzles with the negative pressure tank.

In the configuration described above, the negative pressure tank and the air pump which are suction force generation mechanisms shared by the suction nozzles can generate the suction force in the suction nozzles and suction the ink from the ink receptor. Accordingly, it is possible to collect the ink from the ink receptors while suppressing the increase of the apparatus size in the inkjet printer including the multiple inkjet heads and the multiple ink receptors.

DETAILED DESCRIPTION

Figure 1:
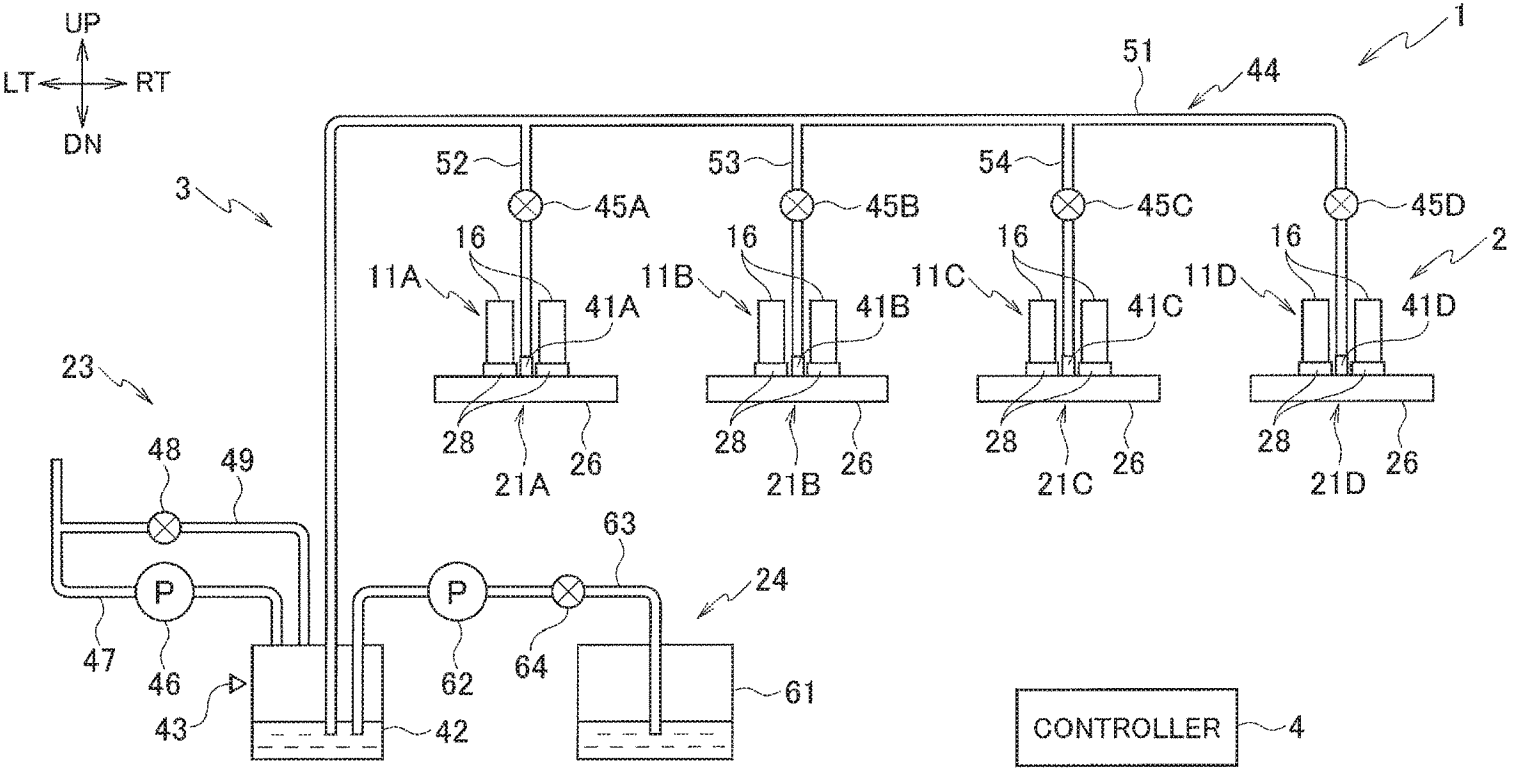
FIG. 1 is a schematic configuration diagram of an inkjet printer according to an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
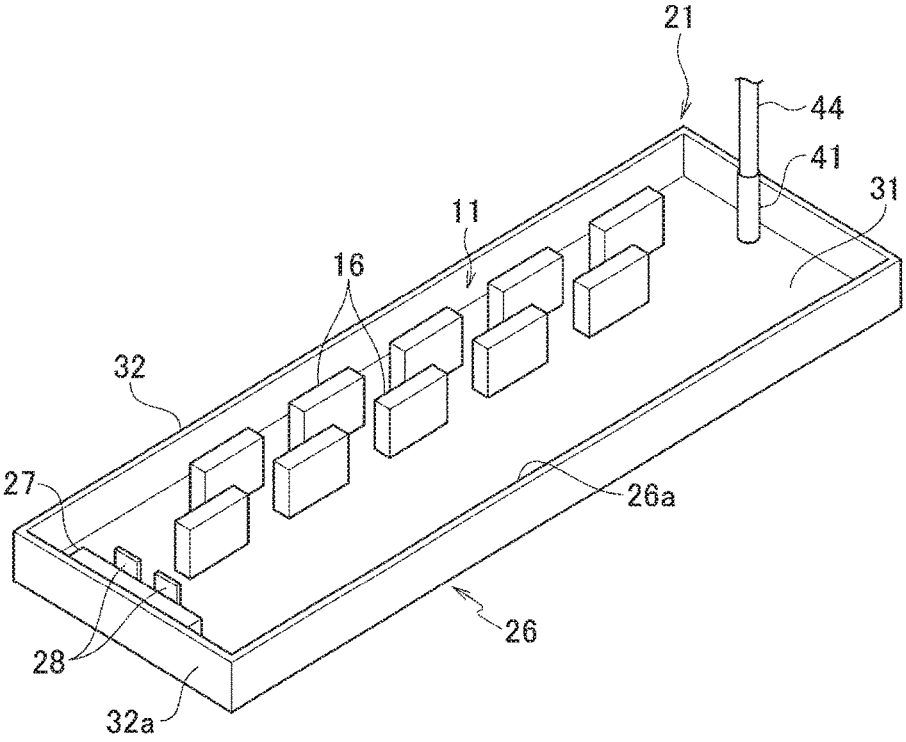
FIG. 2 is a perspective view of a main portion of a maintenance unit and an inkjet head in the inkjet printer illustrated in FIG. 1.
Figure 3A:
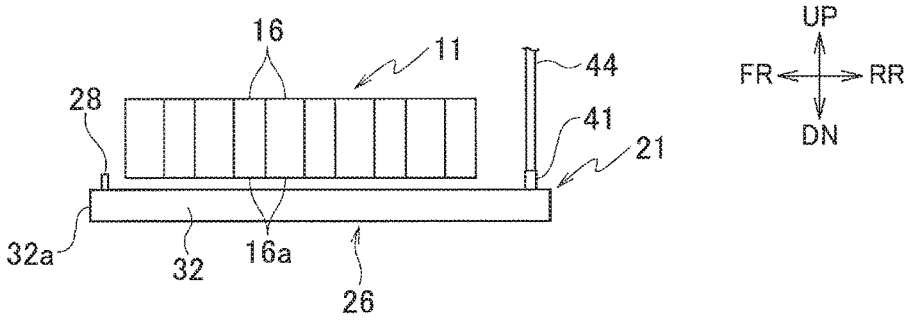
FIG. 3A is an explanatory diagram of a deployment position of an ink receptor in the inkjet printer illustrated in FIG. 1.
Figure 3B:
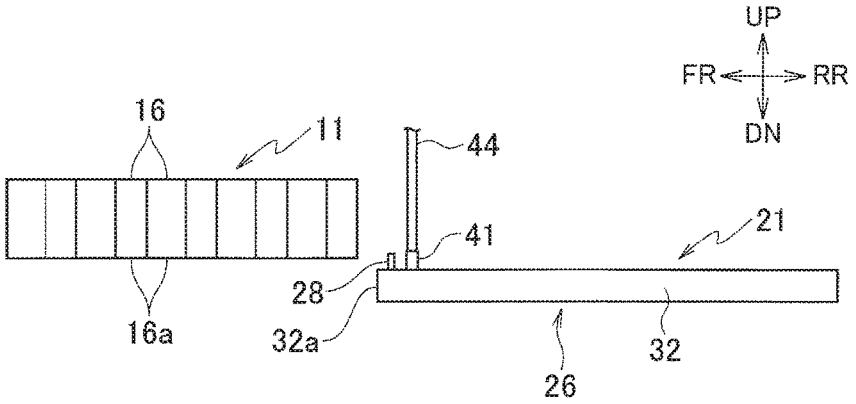
FIG. 3B is an explanatory diagram of a retreat position of the ink receptor.
Figure 4:
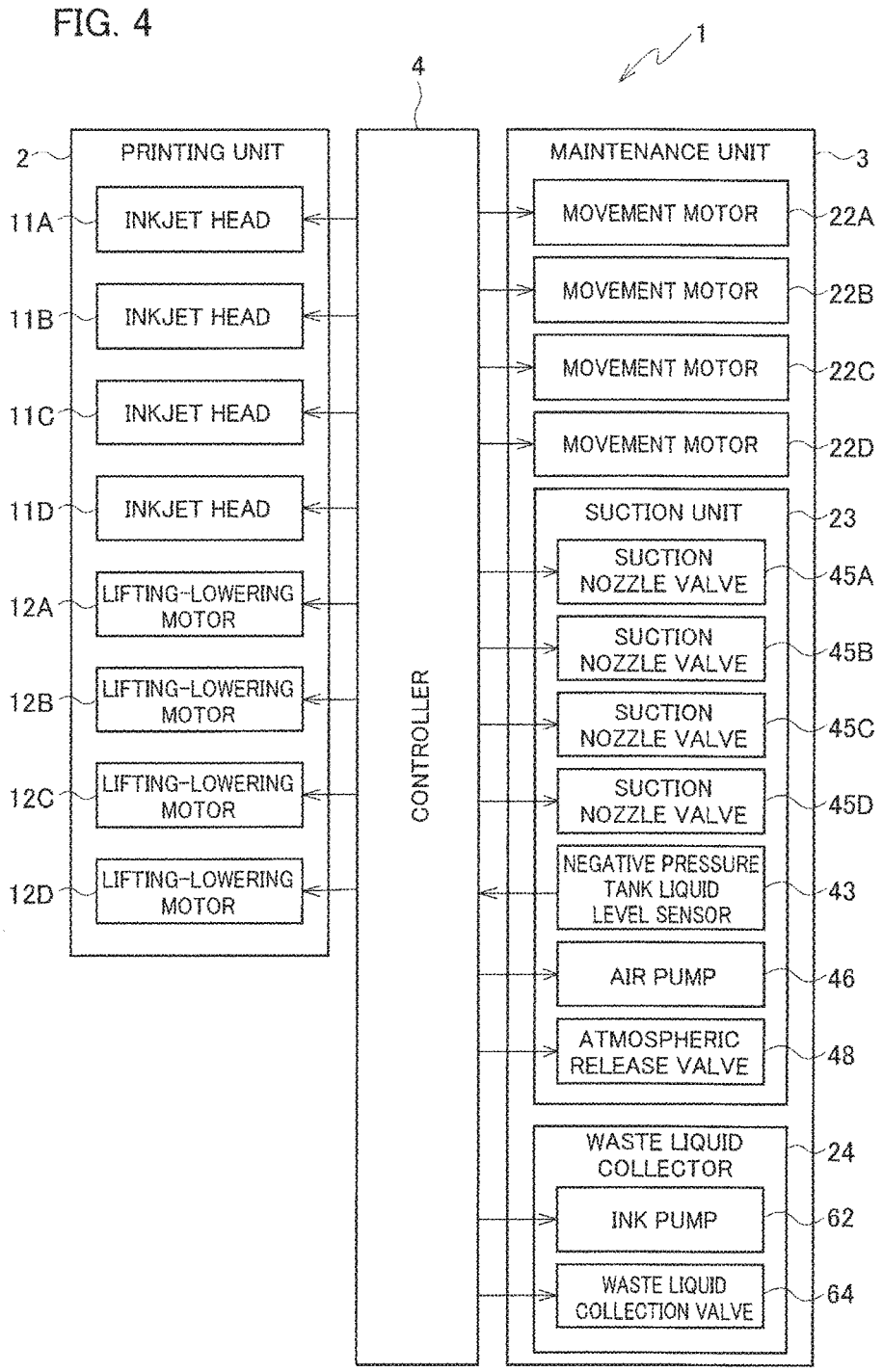
FIG. 4 is a control block diagram of the inkjet printer illustrated in FIG. 1.

FIG. 1 is a schematic configuration diagram of an inkjet printer 1 according to an embodiment of the present invention. FIG. 2 is a perspective view of a main portion of a maintenance unit 3 and inkjet heads 11A to 11D of the inkjet printer 1 illustrated in FIG. 1. FIG. 3A is an explanatory view of deployment positions of wiping units 21A to 21D in the inkjet printer 1 illustrated in FIG. 1. FIG. 3B is an explanatory view of retreat positions of the wiping units 21A to 21D. FIG. 4 is a control block diagram of the inkjet printer 1 illustrated in FIG. 1. In the following description, a direction orthogonal to the sheet surface of FIG. 1 is referred to as front-rear direction and direction toward the viewer is referred to as front direction. Moreover, up, down, left, and right in the sheet surface of FIG. 1 are referred to as up, down, left, and right directions. In FIGS. 1, 3A, and 3B, the right, left, up, down, front, and rear directions are denoted by RT, LT, UP, DN, FR, and RR. Note that FIGS. 1 and 2 are views illustrating a state where ink receptors 26 are disposed at the deployment positions.

As illustrated in FIGS. 1 and 4, the inkjet printer 1 includes a printing unit 2, a maintenance unit 3, and a controller 4.

The printing unit 2 prints an image on a print medium (not illustrated). The printing unit 2 includes the inkjet heads 11A to 11D and lifting-lowering motors 12A to 12D. Note that the inkjet heads 11A to 11D and the like are sometimes collectively referred to by omitting the alphabets attached to the reference numerals.

The inkjet heads 11 print an image on a print medium conveyed in a left-right direction (sub-scanning direction) by ejecting inks. The inkjet heads 11A to 11D eject inks of different colors (for example, black, cyan, magenta, and yellow), respectively. The inkjet heads 11 are configured to be capable being lifted and lowered.

As illustrated in FIG. 2, each inkjet head 11 includes ten head modules 16. In the inkjet head 11, the ten head modules 16 are arranged in a zigzag pattern. Specifically, in the inkjet head 11, the ten head modules 16 are arranged in the front-rear direction (main scanning direction) with the positions thereof in the left-right direction (sub-scanning direction) being alternately shifted.

Each of the head modules 16 has multiple nozzles (not illustrated) arranged in the main scanning direction and ejects the ink from the nozzles. The nozzles are open on a nozzle surface 16*a* which is a lower surface of the head module 16.

The lifting-lowering motors 12A to 12D lift and lower the inkjet heads 11A to 11D, respectively.

The maintenance unit 3 performs maintenance of the inkjet heads 11. The maintenance unit 3 includes the wiping units 21A to 21D, movement motors 22A to 22D, a suction unit 23, and a waste liquid collector 24.

The wiping units 21A to 21D are provided to correspond to the inkjet heads 11A to 11D, respectively. The wiping units 21A to 21D wipe the nozzles surfaces 16*a* of the head modules 16 in the inkjet heads 11A to 11D, respectively. As illustrated in FIG. 2, each of the wiping units 21 (21A to 21D) includes an ink receptor 26, a wiper attachment base 27, and two wipers 28.

The ink receptor 26 is a member which receives the ink ejected from the inkjet head 11 by purging in the maintenance as waste liquid. The ink receptor 26 has a tray shape whose upper side is open. Specifically, the ink receptor 26 includes a rectangular bottom plate 31 and a surrounding wall 32 standing upright in a periphery of the bottom plate, and an upper end of the surrounding wall 32 defines an opening 26*a*. The ink receptor 26 is horizontally movable between the deployment position and the retreat position. As illustrated in FIG. 3A, the deployment position of the ink receptor 26 is directly below the inkjet head 11. As illustrated in FIG. 3B, the retreat position of the ink receptor 26 is a position retreated rearward from the position directly below the inkjet head 11. The retreat position and the deployment position are at the same height.

The wiper attachment base 27 is a member to which the wipers 28 are attached. The wiper attachment base 27 is fixed to a front wall 32*a* which is a portion of the surrounding wall 32 of the ink receptor 26 extending along the front side of the bottom plate 31.

The wipers 28 are members which wipe the nozzle surfaces 16*a*. The wipers 28 are made of elastically-deformable material such as rubber and are formed in a plate shape. The wipers 28 are fixed to the wiper attachment base 27. Upper ends of the wipers 28 are located above the upper end of the surrounding wall 32. The two wipers 28 are arranged side by side in a left-right direction. The left wiper 28 wipes the nozzle surfaces 16*a* of the five head modules 16 arranged on the left side out of the ten head modules 16 arranged in zigzag. The right wiper 28 wipes the nozzle surfaces 16*a* of the five head modules 16 arranged on the right side.

The movement motors 22A to 22D horizontally move the wiping units 21A to 21D, respectively, in the front-rear direction between the deployment positions and the retreat positions. In this description, horizontally moving each wiping unit 21 between the deployment position and the retreat position is the same meaning as horizontally moving the ink receptor 26 between the deployment position and the retreat position.

The suction unit 23 suctions the ink in the ink receptors 26 of the wiping units 21A to 21D through the openings 26*a* of the ink receptors 26. The suction unit 23 includes suction nozzles 41A to 41D, a negative pressure tank 42, a negative pressure tank liquid level sensor 43, an ink suction passage 44, suction nozzle valves 45A to 45D, an air pump 46, an air pump pipe 47, an atmospheric release valve 48, and an atmospheric release pipe 49.

The suction nozzles 41A to 41D are provided to correspond to the ink receptors 26 of the wiping units 21A to 21D, respectively. The suction nozzles 41A to 41D are nozzles which suction the ink in the ink receptors 26 of the wiping units 21A to 21D through the openings 26*a*.

Each of the suction nozzles 41 (41A to 41D) are arranged to be fixed above the bottom plate 31 of the corresponding ink receptor 26, within a movable range of the ink receptor 26. Specifically, as illustrated in FIGS. 2, 3A, and 3B, in the front-rear direction, the suction nozzle 41 is installed to be located in a rear end portion of the ink receptor 26 at the deployment position and in a front end portion of the ink receptor 26 at the retreat position. In the up-down direction, the suction nozzle 41 is installed above the bottom plate 31 of the ink receptor 26 such that a front end (lower end) of the suction nozzle 41 where a suction opening is opened is away from the bottom plate 31 by a predetermined distance. In the left-right direction, the suction nozzle 41 is installed in a center portion of the ink receptor 26.

The negative pressure tank 42 is a tank in which a negative pressure is generated for suctioning the ink in the ink receptors 26 by the suction nozzles 41 and which stores the ink suctioned by the suction nozzles 41.

The negative pressure tank liquid level sensor 43 detects whether the liquid level of the ink stored in the negative pressure tank 42 is a specified height or more.

The ink suction passage 44 is a passage connecting the suction nozzles 41A to 41D with the negative pressure tank 42. The ink suction passage 44 includes a main suction pipe 51 and branching suction pipes 52 to 54.

The main suction pipe 51 forms an ink flow passage from the suction nozzle 41D to the negative pressure tank. Moreover, the main suction pipe 51 forms part of ink flow passages from the suction nozzles 41A to 41C to the negative pressure tank. One end of the main suction pipe 51 is connected to the suction nozzle 41D and the other end thereof is connected to the negative pressure tank 42.

The branching suction pipes 52 to 54 form ink flow passages from the suction nozzles 41A to 41C to the main suction pipe 51, respectively. One end of the branching suction pipe 52 is connected to the suction nozzle 41A and the other end thereof is connected to the main suction pipe 51. One end of the branching suction pipe 53 is connected to the suction nozzle 41B and the other end thereof is connected to the main suction pipe 51. One end of the branching suction pipe 54 is connected to the suction nozzle 41C and the other end thereof is connected to the main suction pipe 51.

The suction nozzle valves 45A to 45D are provided in the ink suction passage 44 to correspond to the suction nozzles 41A to 41D, respectively, and each switch the corresponding suction nozzle 41 between a state communicating with the negative pressure tank 42 and a state disconnected from the negative pressure tank 42.

Specifically, the suction nozzle valve 45A is disposed in the branching suction pipe 52 and switches the ink flow passage in the branching suction pipe 52 between an open state and a closed state. The suction nozzle valve 45B is disposed in the branching suction pipe 53 and switches the ink flow passage in the branching suction pipe 53 between the open state and the closed state. The suction nozzle valve 45C is disposed in the branching suction pipe 54 and switches the ink flow passage in the branching suction pipe 54 between the open state and the closed state. The suction nozzle valve 45D is disposed in the main suction pipe 51 between the suction nozzle 41D and a point where the branching suction pipe 54 is connected, and switches the ink flow passage in the main suction pipe 51 between the open state and the closed state.

The air pump 46 suctions air from the negative pressure tank 42 to generate a negative pressure in the negative pressure tank 42. The air pump 46 is disposed in the air pump pipe 47.

The air pump pipe 47 forms a passage for air suctioned by the air pump 46 from the negative pressure tank 42. One end of the air pump pipe 47 is connected to the negative pressure tank 42 and the other end (atmosphere communication end) thereof communicates with the atmosphere.

The atmospheric release valve 48 opens and closes an air flow passage in the atmospheric release pipe 49 to switch the negative pressure tank 42 between a sealed state and an atmospheric release state.

The atmospheric release pipe 49 forms the air flow passage for opening the negative pressure tank 42 to the atmosphere. One end of the atmospheric release pipe 49 is connected to the negative pressure tank 42 and the other end thereof is connected to a portion of the air pump pipe 47 between the air pump 46 and the atmosphere communication end.

The waste liquid collector 24 collects the ink from the negative pressure tank 42 as the waste liquid and stores it. The waste liquid collector 24 includes a waste liquid tank 61, an ink pump 62, a waste liquid collection pipe 63, and a waste liquid collection valve 64.

The waste liquid tank 61 stores the ink sent from the negative pressure tank 42 as the waste liquid.

The ink pump 62 sends the ink from the negative pressure tank 42 to the waste liquid tank 61. The ink pump 62 is disposed in the waste liquid collection pipe 63.

The waste liquid collection pipe 63 forms a flow passage for the ink sent from the negative pressure tank 42 to the waste liquid tank 61. One end of the waste liquid collection pipe 63 is connected to the negative pressure tank 42 and the other end thereof is connected to the waste liquid tank 61.

The waste liquid collection valve 64 switches the ink flow passage in the waste liquid collection pipe 63 between an open state and a closed state.

The controller 4 controls operations of units in the inkjet printer 1. The controller 4 includes a CPU, a RAM, a ROM, a hard disk drive, and the like.

Next, a maintenance operation of the inkjet heads 11 in the inkjet printer 1 is described.

Figure 5:
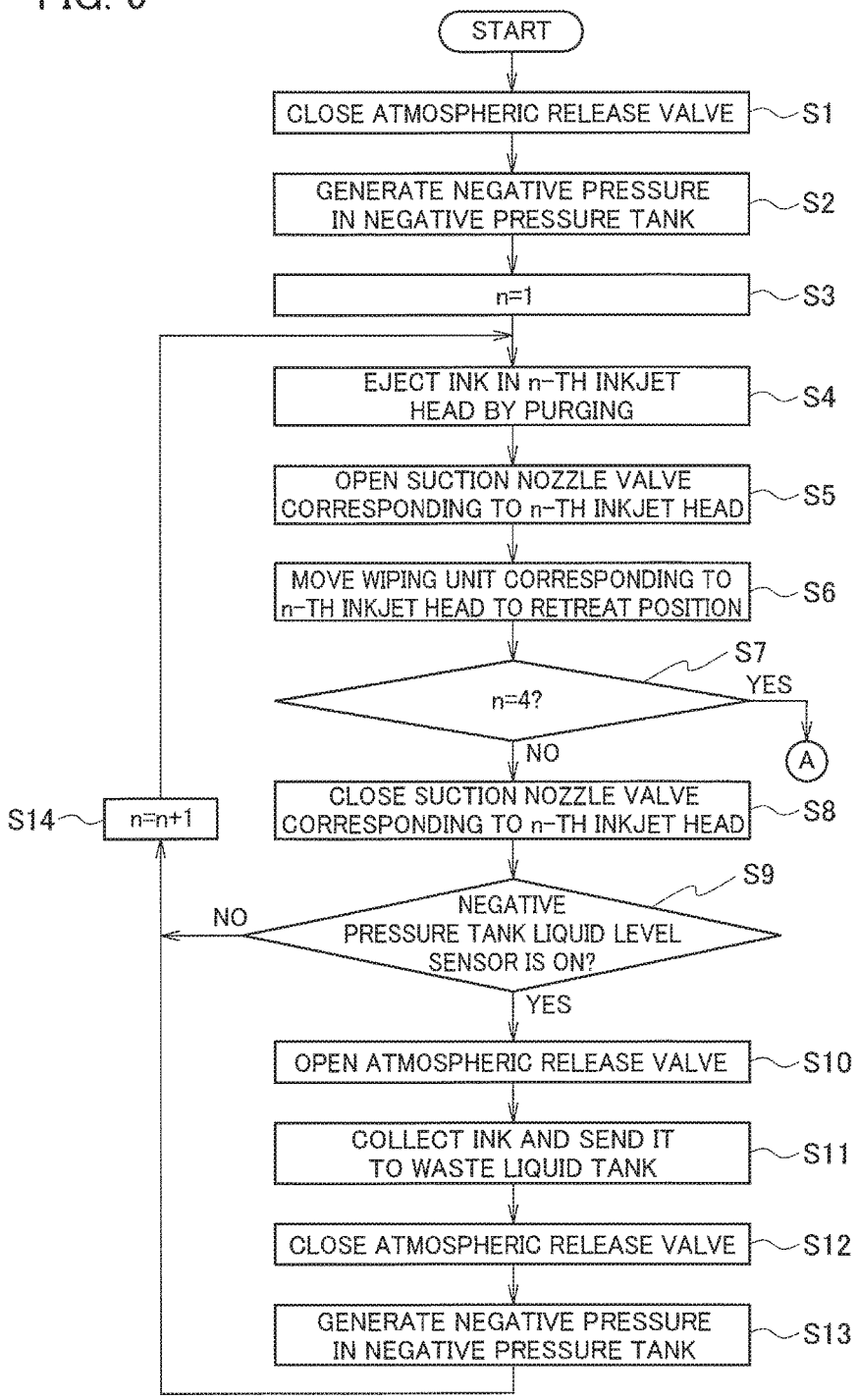
FIG. 5 is a flowchart for explaining a maintenance operation of the inkjet head.
Figure 6:
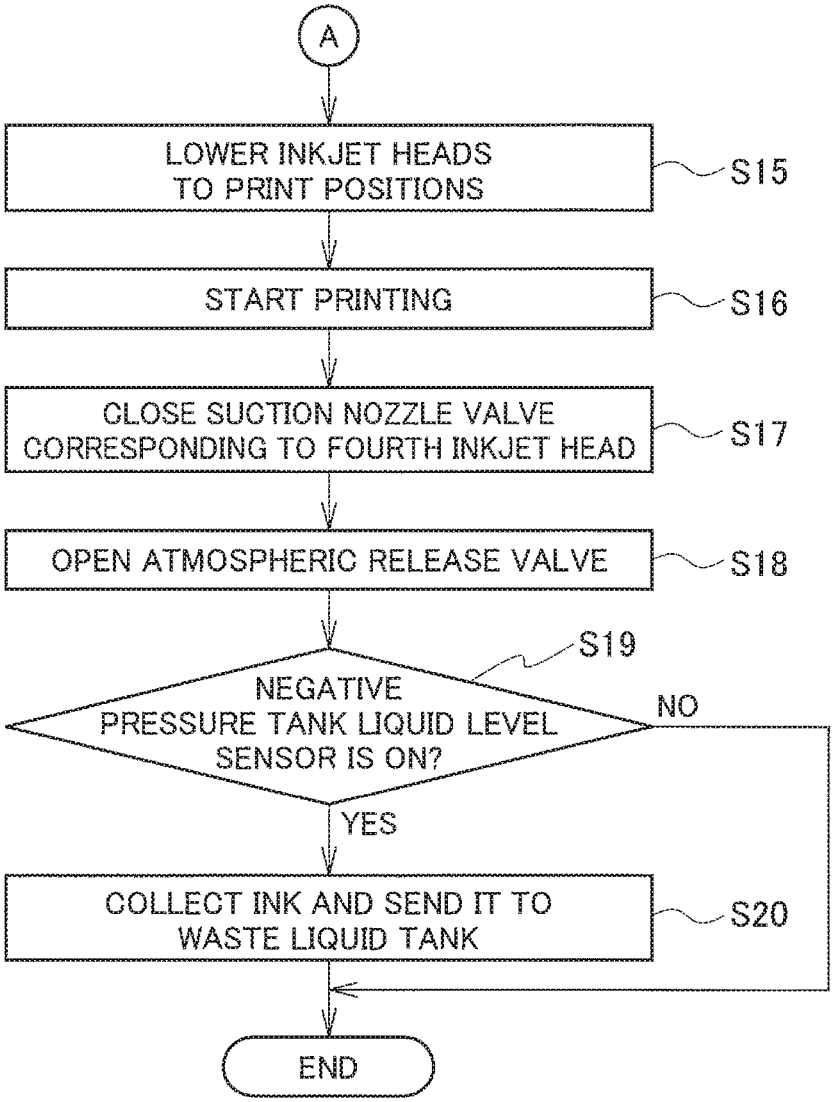
FIG. 6 is a flowchart for explaining the maintenance operation of the inkjet head.

The maintenance operation of the inkjet heads 11 is performed, for example, before start of printing in the case where the inkjet printer 1 is instructed to start the printing. Here, description is given of the case where the maintenance operation is performed before the start of printing. FIGS. 5 and 6 are flowcharts for explaining the maintenance operation of the inkjet heads 11.

In a standby state before the start of printing in the inkjet printer 1, as illustrated in FIG. 3A, the wiping units 21 (ink receptors 26) are disposed at the deployment positions. In this case, the inkjet heads 11 are disposed at standby positions (maintenance positions). The standby positions of the inkjet heads 11 are above print positions which are the height positions of the inkjet heads 11 in the printing. When the inkjet heads 11 are disposed at the standby positions and the wiping units 21 are disposed at the deployment positions, the upper ends of the wipers 28 are located above the nozzle surfaces 16*a* of the inkjet heads 11. Moreover, in the standby state before the start of printing in the inkjet printer 1, the suction nozzle valves 45A to 45D and the waste liquid collection valve 64 are closed and the atmospheric release valve 48 is open.

In step S1 of FIG. 5, the controller 4 closes the atmospheric release valve 48. The negative pressure tank 42 is thereby set to the sealed state.

Next, in step S2, the controller 4 generates the negative pressure in the negative pressure tank 42. Specifically, first, the controller 4 starts drive of the air pump 46. Air is thereby suctioned from the negative pressure tank 42 and the inside of the negative pressure tank 42 starts to be depressurized. Then, when a not-illustrated pressure sensor detects that the pressure inside the negative pressure tank 42 reaches a certain preset pressure which is the negative pressure, the controller 4 stops the air pump 46.

Then, in step S3, the controller 4 sets a variable n indicating the number of the maintenance of the inkjet heads 11 in the order of execution to "1". In this case, the maintenance is executed in the order of the inkjet head 11A to 11D.

Next, in step S4, the controller 4 causes the n-th inkjet head 11 to eject the ink from the nozzles by performing purging. The ink ejected from the nozzles thereby attaches to the nozzle surfaces 16*a*. Moreover, the ink not attaching to the nozzle surfaces 16*a* drops from the nozzle surfaces 16*a* and is received by the ink receptor 26.

Then, in step S5, the controller 4 opens the suction nozzle valve 45 corresponding to the n-th inkjet head 11. The suction nozzle 41 corresponding to the n-th inkjet head 11 thereby starts suction of the ink in the ink receptor 26 by means of the negative pressure in the negative pressure tank 42.

Then, in step S6, the controller 4 moves the wiping unit 21 corresponding to the n-th inkjet head 11 from the deployment position to the retreat position.

In this case, as described above, since the inkjet head 11 is at the standby position, the upper ends of the wipers 28 are located above the nozzle surface 16*a*. Thus, when the wiping unit 21 moves from the deployment position to the retreat position, the wipers 28 come into contact with the head modules 16. When coming into contact with the head modules 16, the wipers 28 are pressed against the head modules 16 and elastically deform. Then, upper end portions of the wipers 28 slide on (wipe) the nozzle surfaces 16*a* as the wiping unit 21 moves.

The ink attaching onto the nozzle surfaces 16*a* is thereby removed. Together with the ink, dust and the like on the nozzle surfaces 16*a* are removed and the nozzle surfaces 16*a* are thereby cleaned. The ink removed from the nozzle surfaces 16*a* by the wipers 28 flows to the ink receptor 26.

While the wiping unit 21 is moving from the deployment position to the retreat position, the suction nozzle 41 suctions the ink in the ink receptor 26. The ink suctioned from the ink receptor 26 by the suction nozzle 41 flows into the negative pressure tank 42 through the ink suction passage 44.

Next, in step S7, the controller 4 determines whether the variable n is "4" which is the last number of maintenance in the order of execution.

When the controller 4 determines that n is not 4 (step S7: NO), in step S8, the controller 4 closes the suction nozzle valve 45 corresponding to the n-th inkjet head 11. The suction of ink by the suction nozzle 41 corresponding to the n-th inkjet head 11 is thereby stopped.

Then, in step S9, the controller 4 determines whether the negative pressure tank liquid level sensor 43 is on. Note that the negative pressure tank liquid level sensor 43 is on when the liquid level of the ink in the negative pressure tank 42 is the specified height or more.

When the controller 4 determines that the negative pressure tank liquid level sensor 43 is on (step S9: YES), in step S10, the controller 4 opens the atmospheric release valve 48. The negative pressure tank 42 is thereby set to the atmospheric release state.

Next, in step S11, the controller 4 performs control such that the waste liquid collector 24 collects the ink from the negative pressure tank 42 and sends it to the waste liquid tank 61. Specifically, the controller 4 opens the waste liquid collection valve 64 and drives the ink pump 62 for specified time. The ink is thereby sent from the negative pressure tank 42 to the waste liquid tank 61 and the negative pressure tank liquid level sensor 43 is turned off.

Next, in step S12, the controller 4 closes the atmospheric release valve 48. The negative pressure tank 42 is thereby set to the sealed state.

Then, in step S13, the controller 4 generates the negative pressure in the negative pressure tank 42 as in step S2 described above.

Next, in step S14, the controller 4 increments the variable n by "1." Thereafter, the controller 4 returns to step S4.

When the controller 4 determines that the negative pressure tank liquid level sensor 43 is off in step S9 (step S9: NO), the controller 4 skips steps S10 to S13 and proceeds to step S14.

When the controller determines that n is 4 in step S7 (step S7: YES), in step S15 of FIG. 6, the controller 4 lowers the inkjet heads 11A to 11D from the standby positions to the print positions. Note that, lowering of each of the inkjet heads 11A to 11C from the standby position to the print position may be performed at timing depending on a moment when the corresponding one of the suction nozzles 41A to 41C stops suctioning the ink.

Next, in step S16, the controller 4 starts printing of an image by using the inkjet heads 11A to 11D.

Then, in step S17, after a predetermined time elapses from the start of printing, the controller 4 closes the suction nozzle valve 45D corresponding to the fourth inkjet head 11D. The suction of the ink by the suction nozzle 41D corresponding to the fourth inkjet head 11D is thereby stopped.

Next, in step S18, the controller 4 opens the atmospheric release valve 48. The negative pressure tank 42 is thereby set to the atmospheric release state.

Then, in step S19, the controller 4 determines whether the negative pressure tank liquid level sensor 43 is on.

When the controller 4 determines that the negative pressure tank liquid level sensor 43 is on (step S19: YES), in step S20, the controller 4 performs control such that the waste liquid collector 24 collects the ink from the negative pressure tank 42 and sends it to the waste liquid tank 61 as in step S11 described above. A series of operations is thereby completed.

When the controller 4 determines that the negative pressure tank liquid level sensor 43 is off in step S19 (step S19: NO), step S20 is skipped and the series of operations is completed.

As described above, in the inkjet printer 1, the suction nozzles 41 disposed above the bottom plates 31 within the movable ranges of the ink receptors 26 suction the ink in the ink receptors 26 through the openings 26*a* on the upper sides of the ink receptors 26.

Thus, unlike in a configuration in which the ink in the ink receptor flows to the waste liquid tank via an ink passage extending downward from a bottom surface of the ink receptor, a standby space for the ink passage with a length corresponding to the movement distance of the ink receptor does not have to be provided below the ink receptor. As a result, the inkjet printer 1 can suppress an increase of an apparatus size.

Since there is no ink passage which moves together with the ink receptor, complex routing of the ink passage is avoided.

In the inkjet printer 1, the suction unit 23 includes the negative pressure tank 42 in which the negative pressure is generated for suctioning the ink by the suction nozzles 41A to 41D, the air pump 46 which generates the negative pressure in the negative pressure tank 42, and the ink suction passage 44 which connects the suction nozzles 41A to 41D with the negative pressure tank 42.

The negative pressure tank 42 and the air pump 46 which are suction force generation mechanisms shared by the suction nozzles 41 can thereby generate the suction force in the suction nozzles 41 and suction the ink from the ink receptors 26. Accordingly, it is possible to collect the ink from the ink receptors 26 while suppressing the increase of the apparatus size in the inkjet printer 1 including the multiple inkjet heads 11 and the multiple ink receptors 26.

Note that, in the embodiment described above, the suction nozzle valves 45A to 45D are provided in the ink suction passage 44 and the ink is suctioned sequentially from each of the ink receptors 26 by opening and closing the suction nozzle valves 45A to 45D. However, the configuration may be such that the suction nozzle valves 45A to 45D are omitted and the wiping by the wiping units 21 and the suction of ink from the ink receptors 26 may be performed in parallel for all inkjet heads 11.

In the embodiment described above, the suction force is generated in the suction nozzles 41 by using the negative pressure generated in the negative pressure tank 42 by the air pump 46. However, the configuration for generating the suction force in the suction nozzles 41 is not limited to this. For example, the configuration may be such that ink pumps corresponding to the respective ink suction nozzles are provided to generate the suction force in the suction nozzles.

In the embodiment described above, description is given of the inkjet printer including four inkjet heads and four wiping units. However, the numbers of inkjet heads and the number of wiping units are not limited to this.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer comprising:

at least one ink receptor having a tray shape with a bottom plate and an opening facing upward, the at least one ink receptor being horizontally movable and configured to receive ink ejected from at least one inkjet head as waste liquid; and a suction unit comprising at least one suction nozzle arranged above the bottom plate within a movable range of the at least one ink receptor, the suction unit configured to suction the ink in the at least one ink receptor through the opening with the at least one suction nozzle, wherein the at least one ink receptor is movable with respect to the at least one suction nozzle.

2. The inkjet printer according to claim 1, wherein the at least one inkjet head comprises inkjet heads, the at least one ink receptor comprises ink receptors corresponding to the inkjet heads, respectively, the at least one suction nozzle comprises suction nozzles corresponding to the ink receptors, respectively, and the suction unit comprises:

a negative pressure tank shared by the suction nozzles and in which a negative pressure is generated for suctioning the ink in the ink receptors by the suction nozzles, the negative pressure tank configured to store the ink suctioned by the suction nozzles;

an air pump shared by the suction nozzles and configured to generate the negative pressure in the negative pressure tank; and an ink suction passage connecting the suction nozzles with the negative pressure tank.

* * * * *